US005444198A

United States Patent [19]

Gallas

[11] Patent Number: 5,444,198

[45] Date of Patent: Aug. 22, 1995

[54] TRAP FOR CONTROLLING STANDING WAVES IN ROOMS

[76] Inventor: John M. Gallas, P.O. Box 8550, Universal City, Calif. 91608

[21] Appl. No.: 177,236

[22] Filed: Jan. 4, 1994

[51] Int. Cl.[6] ..... E04B 1/82

[52] U.S. Cl. ..... 181/295

[58] Field of Search ..... 181/295, 296, 30, 286

[56] References Cited

U.S. PATENT DOCUMENTS

| | | | |
|---|---|---|---|
| 4,319,661 | 3/1982 | Proudfoot | 181/295 |
| 4,548,292 | 10/1985 | Noxon | 181/295 |
| 5,035,298 | 7/1991 | Noxon | 181/295 |
| 5,137,111 | 8/1992 | Diduck et al. | 181/295 |
| 5,210,383 | 5/1993 | Noxon | 181/295 X |

*Primary Examiner*—Khanh Dang

[57] ABSTRACT

This invention is an improved bass trap for controlling standing waves in the listening room. It is cylindrical in shape, with a curved diffuser around one half of the length of the cylinder. The interior of the cylinder is divided into two hemi-cylinders, with one hemi-cylinder made of an absorbing material positioned opposite the curved diffuser, and one hemi-cylinder, which is an air cavity, defined by the boundary of the absorbing material on one side and the diffuser on the other. This device features a ported top, with the ports positioned over the air cavity, which allow tuning pipes of varying length and diameter to be inserted, in order to permit further tuning of the device.

9 Claims, 2 Drawing Sheets

TRAP FOR CONTROLLING STANDING WAVES IN ROOMS

BACKGROUND—FIELD OF INVENTION

This invention concerns a device for controlling standing waves in a listening room so that decay rate of room resonances is increased and at the same time, attack is sharpened.

BACKGROUND—DESCRIPTION OF PRIOR ART

U.S. Pat. No. 4,548,292 to Arthur Noxon discloses a noise control device for corner placement which is described as follows: A cylinder made from a fiberglass tube, hollow in the center, closed at each end with a solid end cap. The fiberglass tube is then covered along one half of the side by a "limp mass", which is a sheet of flexible material with holes of various size and placement. The function of the 'limp mass' is to reflect frequencies above 360 Hz., and to pass lower frequencies into the center of the cylinder, where some is transformed into heat, and some is time delayed. While the device in the present application is similar in its external shape to Mr. Noxon's, and both can be tuned by rotating them in the listening room, the device in the present application differs in the following significant ways: where Mr. Noxon Uses a fiberglass tube, as an absorbing material, the device in this application uses a dacron-poly wool material formed in a hemi-cylinder; that is to say, all the absorbing material is on one side of the cylinder, and a hollow cavity, also shaped as a hemi-cylinder, is between the absorbing hemi-cylinder and the curved diffusing sheet. Where Mr. Noxon uses solid end caps to seal in the central air cavity; the device in this application features ports on the top, located over the air cavity, into which tuning pipes of varying length and diameter may be inserted, to further alter the effect of the device. Finally, Mr. Noxon uses a "limp mass" around one side of the cylinder. The device in this application uses a solid, flexible sheet of cork, which does not permit sound into the center of the cylinder, and acts as a curved diffuser at all frequencies.

SUMMARY OF THE INVENTION

A sound trap for use in a room with loudspeakers for controlling standing acoustic waves affecting the room's listening environment is provided and includes a frame and end walls defining a first volume which is filled with a sound absorbent wool, and a second a second volume having a common surface in sound communication with the first volume including wall means to enclose the same with respect to the room. The first volume is constructed to be open to and in sound communication with the room.

The above elements together form an upright generally cylindrical structure in which the second volume remains empty and is accessed by at least one tuning port communicating with the room.

The curved outer wall has a portion secured and other portions supported by the secured portion.

The curved wall presents an outer concave surface facing the room for diffusing externally arriving sound waves therefrom and further presents a convex inner surface for directing internally arriving sound waves into said first volume for absorption.

BRIEF DESCRIPTION OF THE PREFERRED EMBODIMENTS

Figure 1:
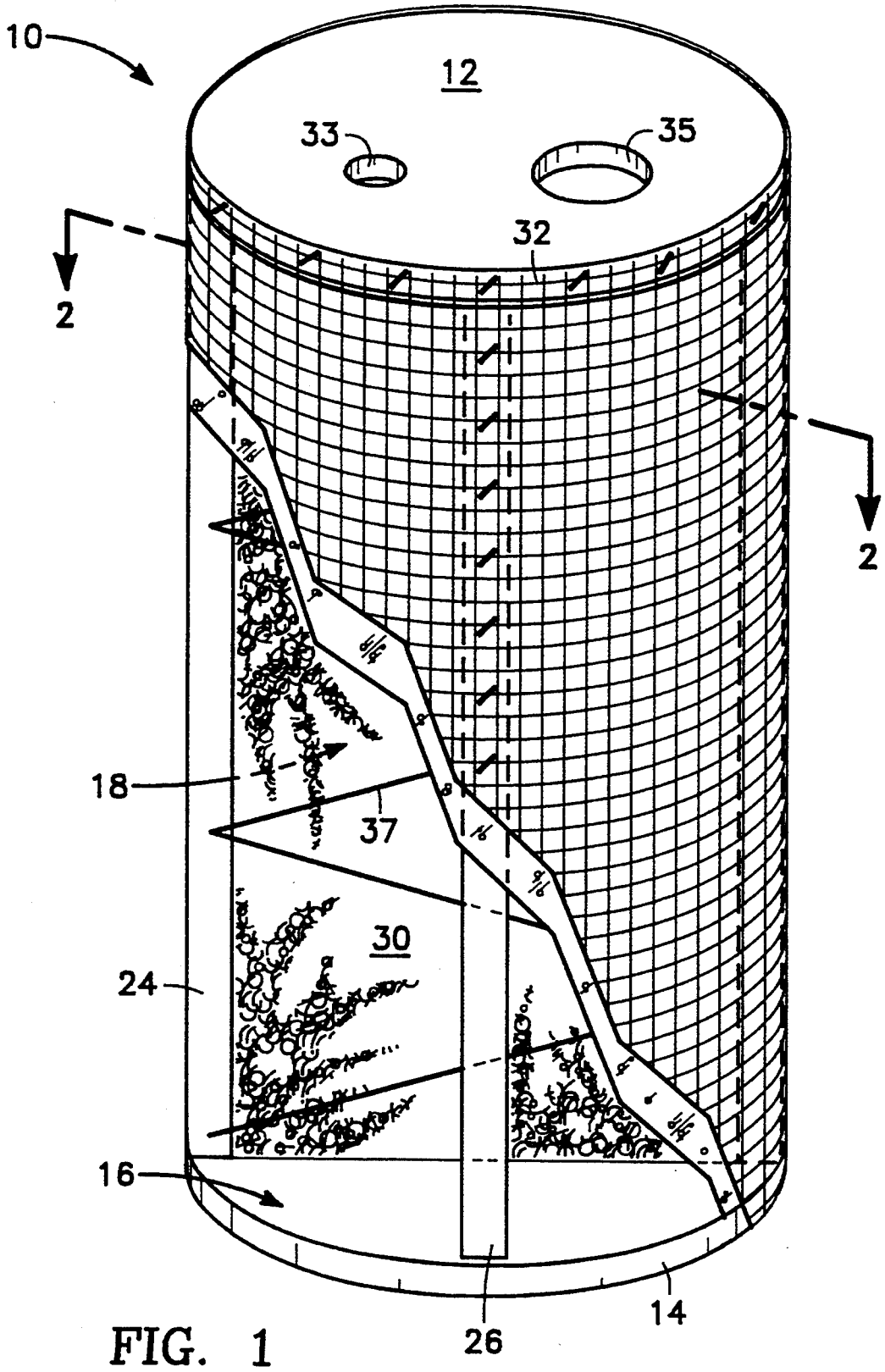
FIG. 1 is perspective view, partly broken away, of a sound trap for controlling standing waves in a room and constructed in accordance with the invention.
Figure 2:
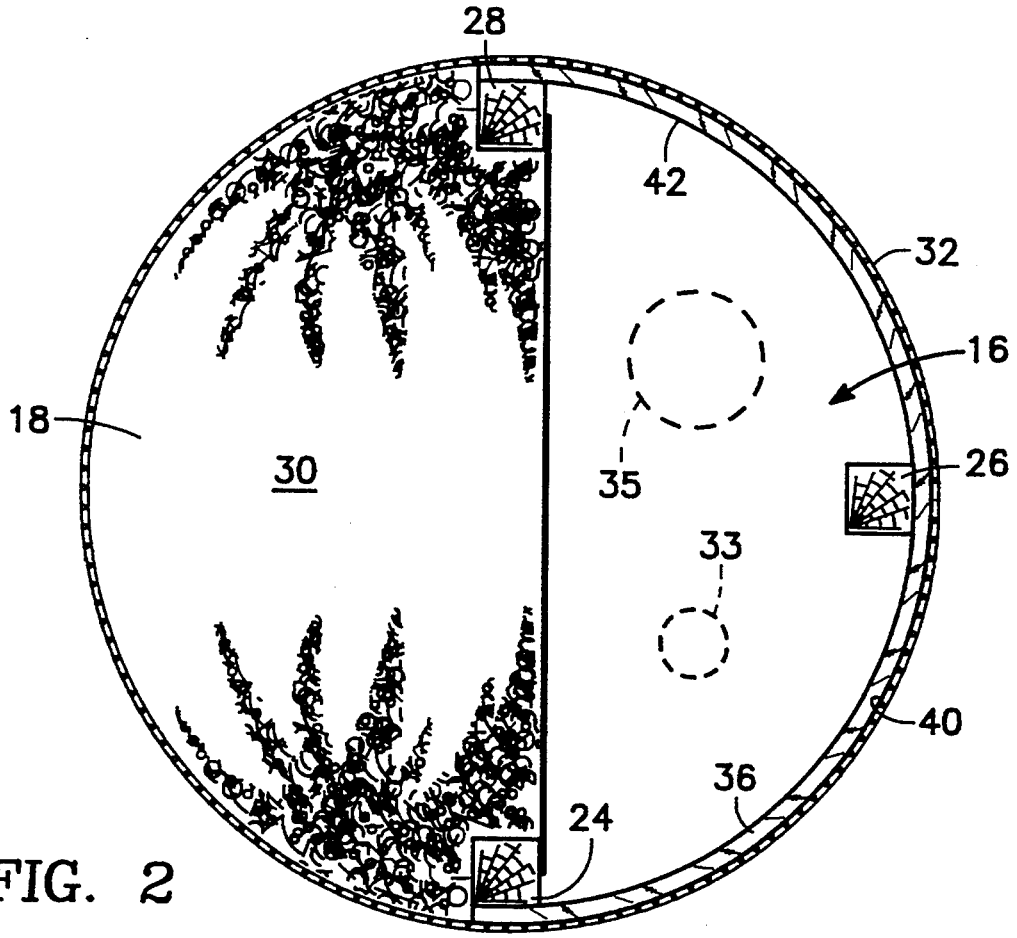
FIG. 2 is a transverse cross-section view of the sound trap of FIG. 1 taken along the lines 2—2 thereof.
Figure 3A:
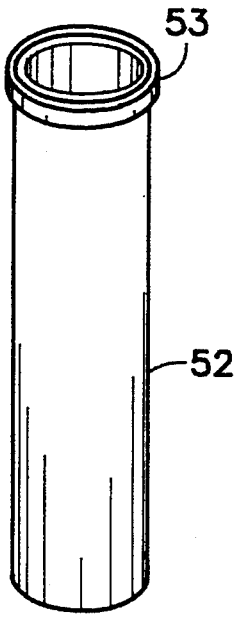
FIGS. 3A and 3B are perspective views of tuning tubes for use in the trap of FIG. 1.
Figure 3B:
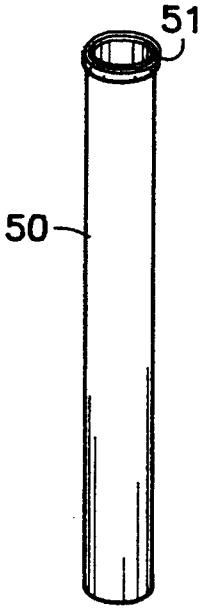
Figure 4A:
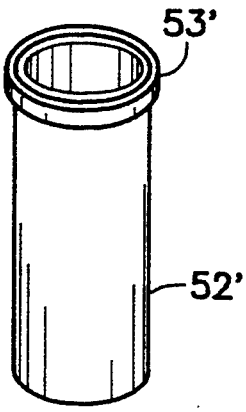
FIGS. 4A and 4B are perspective views of tuning tubes of an alternate dimension for use in the trap of FIG. 1.
Figure 4B:
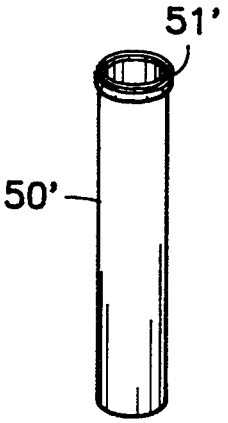

Referring now to FIGS. 1 and 2, the sound trap 10 of the present invention has a generally cylindrical shape of circular cross-section terminated substantially flat top and bottom board walls 12,14 upon the latter of which it stands in an upright position. The trap 10 is approximately four feet in height, which is sufficient to extend to the height of a seated listener.

The interior of the trap 10 is divided vertically into two hemi-cylindrical volumes 16, 18 along a vertical midplane 2 extending from the top wall 12 to the bottom wall 14. Internal structure and support for the trap is provided by three braces or posts 24, 26,28, which may be of wood and spaced at ninety (90) degrees apart immediately adjacent the periphery of the trap and attached at the top and bottom walls 12, 14 by suitable fastening means. An outer sound transparent grill hardware cloth 32 having a cylindrical shape is attached to and supported on the top and bottom walls which, together with the posts provides a self supporting, rigid structure for the trap.

The top wall is provided with a small port 33 and a large port 35 for tuning. The ports may be additionally tuned by insertion of tuning tubes 50, 52, either singly or in combination, of various lengths, as shown in FIGS. 3A, 3B or 4A, 4B. The tubes are held in place by collars 51, 53.

FIG. 2 shows the interior of the two hemi-cylindrical volumes 16, 18, one 18 being open to the room and filled with dacron poly wool fill 30 which serves as a sound absorbent. The fill is held in place on the inside by a string zig-zag barrier 37 and on the outside by the grill or net 32.

The second volume 16 is also of hemi-cylindrical shape and empty but is bounded on the outside by a cork wall of 3/16" thickness secured to a post or brace 26 along its midline. The cork wall is curved to present a convex diffusing surface 40 to the outside and a concave surface 42 to the inside to direct acoustic waves therein into the wool fill 30.

Description of Invention: How to Make it

Parts:

two particle board discs: 12 in. diameter, $\frac{3}{4}$ in. thick.
3 braces: lengths of 2×2 wood, $47\frac{1}{8}$" in. length.
hardware net: $\frac{1}{2}$ in. holes, 48 in. long×38 in. wide.
cork: sheet 3/16 in. thick×$47\frac{1}{8}$ in. long×$18\frac{1}{4}$ in. wide.
cloth: 2 pieces of speaker grill cloth: 14 in.×14 in. and 40 in.×54 in.
stuffing: dacron poly wool, 1 in.×3 ft×$47\frac{1}{8}$ in.
string: 14 ft.
tuning pipes: pvc from plumbing supply.

Note: the diameter and height of the cylinder can be varied to treat problems at different frequencies. Larger diameter cylinder for lower frequencies, smaller diameter cylinder for higher frequencies.

1) Making the Frame

A) The discs are the ends of the cylinder, and are joined by the 3 braces. Attach (with 2 in. wood screws) the 3 braces to one of discs by screwing through the flat surface of the disc into the end of each brace. If the surface of the disc were a clock, position the braces at 12, 3, and 6. Set the braces in from the edge of the disc by 3/16 of an inch. This is the thickness of the cork. Then attach the other disc to the braces in the same manner.

B) Then, in only the top disc, drill 2 holes: one is $1\frac{1}{4}''$, the other is $2\frac{1}{8}''$. To locate the holes, draw two lines, first between 12 and 6, then between 3 and 9. A $1\frac{1}{4}$ in. hole is drilled in the 12 to 3 quarter, and a $2\frac{1}{8}$ in. hole is drilled in the 3 to 6 quarter. The holes should be centered in their quadrants, $2\frac{1}{2}$ in. from the edge of the disc. This is the frame of the device.

II: Attaching the hardware net, stuffing the frame

A) Align the wire net so that the ends will close over the brace at 3 o'clock. Staple the net to the edges of the discs, but only along the half the edge of the disc opposite the quarters that have the holes drilled. At this point, the net is yet to be attached along half the disc edges and along the brace at 3 o'clock.

B) Using the polyester fill, stuff one half the cylinder, bounded by the attached hardware net, the discs, and tile braces at 12 and 6.

C) Make a barrier in order to keep the filling out of the half of the cylinder bounded by the discs and the 3 braces. With nylon string, create a zig zag patterned barrier between the 12 and 6 o'clock brace by stapling the string to the 12 brace, pulling it down to the brace and stapling there, then pulling down back to the other, and etc. until the length of the two braces has a zig zag barrier attached.

III: Adding the Cork and Closing the Cylinder

Place the cork inside the opening where the net is net yet closed, and over the side of the cylinder so that it is supported by all three of the braces. Attach the cork to the center brace with a couple of staples so that it doesn't move around. Staple the rest of the net to the edge of the discs, bringing the net closed around the cork. The ends of the net will now rest above the cork with the center brace beneath. Staple the ends of the net through the cork to the center brace Staples should be spaced at 1 inch intervals.

Finishing the Exterior

Using the cloth, sew a cover to fit the device. This will be a cylinder with one end open and one closed. First pull the cover over the top and down the sides, then pull the ends under the bottom and staple to the bottom surface of the bottom disc. Attach 4 legs to the bottom, each $\frac{7}{8}$ in diameter, $\frac{1}{2}$ in high.

The top cover can be slit over the holes and the operation of the device can be altered by placing pipes of different lengths down these holes. Collars need to be placed at the outer ends of the pipes, so that they do not drop into the Bass Trap. Lengths and diameters are to be determined for best effect by experimentation.

Theory of Operation: How to Use the Device

Placement of the traps in the corners behind the speakers usually works best. The seam on the cover is located over the center of the diffuser. Start with the seam into the corner. As the cylinder is rotated, the effect will change; some may prefer the effect with the seam not in the corner. Unusual speakers, rooms, or speaker placement invite deviation from corner placement.

Dipolar speakers, such as Eminent Technology speakers or Quads load into the room much differently than bass reflex or acoustic suspension designs. Dipolars create a back wave, out of phase with the front wave, which needs to be controlled. If it is not controlled, it can bounce off the rear wall, come around to the front of the speaker still out of phase, and cancel some of the energy from the front wave. This usually appears as a "suckout" around 200 to 250 cycles. Placing the bass trap behind the speaker, seam away from listener, about 1.5 to 2 ft. from the radiating panel seems to work best. Again, rotation of the cylinder will permit tuning of the bass trap.

Some rooms are not rectangular in shape, or it may not be practical to position the speakers symmetrically in the room. At this point, it is a good idea to buy a test CD with third octave test tones. Stereophile offers a good one. You will also need a sound pressure meter. Radio Shack sells one that is good for this exercise (analog display for $32, cat #33-2050, or digital display for $60, cat #33-2055). Put the meter on a tripod in "listening position." Select the 1000 Hz test band and set the volume so that approximately 75 to 80 dB registers on the meter.

Now, make a frequency response graph of your room. To do this, you will select each test band, from 20 Hz to 4000 Hz, and record the dB reading from the meter at each frequency. You can now connect the points and generate a curve. There is usually a "hump" somewhere between 70 and 120 Hz. This "hump" is what the Model 102 is designed to ameliorate. The next step requires you to select a test band closest to the "hump." Let's say that's 80 Hz. Put an 80 Hz tone through the system and put the CD player on repeat for that band. Now take the meter off the tripod and walk around the room, checking readings. You will discover spots in the room where the dB level is much higher than others. These "hot" spots often occur in unexpected places, and are not always symmetrically located. When you have located the "hot" spots, you have also located good places to try positioning the bass traps.

A word about use of the tuning pipes: the majority of speakers are generally "box" designs. They are usually called "bass reflex", or "acoustic suspension" speakers. Use of the tuning pipes is not recommended for these designs. However, for dipolar designs, when the Bass Traps are positioned behind the speaker, use of the tuning pipes provides greater control of room resonances.

I claim:

1. A sound trap for use in a room with loudspeakers for controlling standing acoustic waves affecting the room's listening environment, comprising first means defining a first volume, a sound absorbent wool filling said volume, said first volume being constructed to be open to and in sound communication with said room, second means defining together with said first means a second volume having a common surface in sound communication therewith, said first and second means including walls to enclose the same with respect to the room, said first and second means together forming an upright, generally cylindrical structure, said second volume being empty, port means formed through said second means for accessing said second volume, said second means including a curved outer wall having a first portion thereof secured to said structure and other portions supported by said first, secured portion, said curved wall having an outer convex surface facing the room for diffusing externally arriving sound waves therefrom and further having an inner concave surface for directing internally arriving sound waves into said first volume for absorption.

2. The sound trap of claim 1 further in which said first and second means are contiguous along said common wall boundary and hemi-cylindrical about said outer walls so that said sound trap is circular in cross-section.

3. The sound trap as in claim 1 wherein said first and second means are elongate, and further including, a solid top wall supported on said structure to bound said first and second means, said top wall having at least a first port accessing said second volume.

4. The sound trap as in claim 3 further including a second port accessing said second volume and spaced apart from said first port and of different size from said first port.

5. The trap in claim 3 further including a tuning tube extending from said first port into said second volume and having a diameter of substantially the same as said first port.

6. The trap as in claim 5 further including a second tuning tube extending from said second port into the second volume and having a diameter substantially the same as said second port.

7. The trap as in claim 1 wherein said wool is made of dacron wool fiber.

8. The trap as in claim 1 wherein said curved outer wall comprises a sheet of cork of about 3/16" thickness.

9. The sound trap as in claim 1 further including framing means, and in which said curved outer wall is secured and supported along a line to a portion of said framing means, said other portions of said curved outer wall being free to move in response to arriving acoustic waves.

* * * * *